US005808227A

United States Patent [19]

Amos

[11] Patent Number: 5,808,227

[45] Date of Patent: Sep. 15, 1998

[54] FIREARM REST

[76] Inventor: Byron S. Amos, 805 Dooley Ave., Parkersburg, W. Va. 26101

[21] Appl. No.: 791,581

[22] Filed: Jan. 31, 1997

[51] Int. Cl.[6] ..... F41H 5/00

[52] U.S. Cl. ..... 89/36.01; 42/94

[58] Field of Search ..... 42/94; 89/36.01; 135/901, 87; 43/1

[56] References Cited

U.S. PATENT DOCUMENTS

| | | | |
|---|---|---|---|
| 3,913,598 | 10/1975 | Glutting, Jr. et al. | 135/4 R |
| 4,196,742 | 4/1980 | Owen, Jr. | 135/71 |
| 4,266,748 | 5/1981 | Dalton | 248/425 |
| 4,433,500 | 2/1984 | Kunevicius | 42/1 N |
| 4,575,964 | 3/1986 | Griffin | 42/94 |
| 4,644,987 | 2/1987 | Kiang | 150/52 R |
| 4,676,021 | 6/1987 | Groba | 42/94 |
| 4,882,869 | 11/1989 | Webster | 42/94 |
| 4,922,642 | 5/1990 | Ohlhauser | 42/96 |
| 5,149,900 | 9/1992 | Buck | 42/94 |
| 5,271,176 | 12/1993 | Anderson et al. | 42/106 |
| 5,421,115 | 6/1995 | McKay | 42/94 |

*Primary Examiner*—Charles T. Jordan
*Assistant Examiner*—Meena Chelliah
*Attorney, Agent, or Firm*—Steptoe & Johnson

[57] ABSTRACT

The present invention is a firearm rest having an elongate shaft with a Y shaped cradle such that the branches of the cradle are notched on their periphery, and there is a vertical hole located at a base of one of the branches. The present invention includes a camouflage screen that has a face screen portion and a body screen portion. The face screen portion of the camouflage screen is rectangular in shape and made from two pieces of material, thereby forming a pocket with an opening at its top side. The face screen portion attaches to the branches of the Y shaped cradle of a firearm rest. The body screen portion of the camouflage screen is trapezoidal in shape and attaches to the bottom of the face screen portion. The bottom of the body screen portion can be attached to the ground with stakes to provide broader coverage to a hunter. The present invention also includes an umbrella, the shaft of which fits through the vertical hole located in the Y shaped cradle. The umbrella is further attached to the firearm rest by using a U shaped bolt. The present invention can also be made with a tube having a twisting device located at its top end and a base platform at its bottom end. The elongate shaft of a firearm rest slides through the tube, and the twisting device frictionally holds the elongate shaft in any stationary position.

13 Claims, 5 Drawing Sheets

FIREARM REST

BACKGROUND OF THE INVENTION

1. Field of the Invention

This invention relates to firearm supports or rests, and more specifically to a firearm rest that provides stability, camouflage, and rain coverage for a hunter or target shooter.

2. Related Art

It is well known in the art that hunters and target shooters achieve greater accuracy, success, and safety when their firearm is supported. Further, firearm rests provide stability for handicapped persons, including, but not limited to, children, the elderly, paraplegics, persons with certain medical conditions, such as shaking, and persons who have lost the use of a hand or arm. In each of these instances, the person is incapable of being the sole support of a firearm due to the weight and awkwardness of controlling and aiming the firearm.

Conventional portable firearm rests exist that hunters and target shooters use in the field. A disadvantage with these firearm rests, however, is that the hunter or shooter is not able to use the firearm rest as a walking stick to assist and support him when traveling through the field. Conventional firearm rests are not intended to assist the hunter or shooter with moving in the field, but rather, are intended to be carried by the hunter or shooter into the field. Therefore, by using these conventional firearm rests, a hunter or shooter must carry an additional piece of equipment, thereby retarding the hunter's or shooter's movement and speed in the field.

Another disadvantage with these firearm rests is that they do not, and cannot, assist a hunter or target shooter firing from a vehicle, such as a four wheel drive all terrain vehicle or a flat bottom boat. The conventional portable firearm rests do not provide a means for securing the firearm rest to the vehicle.

Therefore, there is a need for a firearm rest that can be used in the field as well as be securely attached to a vehicle, thereby providing a hunter or target shooter with a choice of shooting platforms.

Another disadvantage with conventional firearm rests is that they do not provide a hunter or shooter with support at different heights in a quiet and efficient manner. These firearm rests either have an awkward adjustment mechanism or no such mechanism at all.

Therefore, there is a need for a firearm rest that can provide support at different heights, both quickly and quietly.

Another disadvantage with conventional firearm rests is that they do not provide a hunter or target shooter with additional storage space. In the field, it is very important for hunters and target shooters to consolidate their equipment, thereby allowing them to move more quietly and quickly. A first aid kit is always essential equipment in the field in case an injury occurs which needs quick attention. Conventional firearm rests, however, do not provide extra storage space for various equipment such as a first aid kit.

Therefore, there is a need for a firearm rest having a storage space for storing various items, thereby consolidating the equipment carried into the field.

Regarding hunters, another disadvantage with conventional firearm rests is that they are not intended to, nor do they, work in conjunction with available camouflage screens. A hunter uses a camouflage screen to prevent the game, such as deer, turkey, etc., from visually detecting him.

The structure and operation of conventional camouflage screens do not take into account the structure of a firearm rest. That is, conventional screens are not designed to work in conjunction with conventional firearm rests, but are designed and intended to only be used with a hunter and his/her firearm. Further, the structure of a firearm rest is often too bulky and protrudes into the camouflage screen. Therefore, a hunter is prevented from effectively using a camouflage screen with a conventional firearm rest.

Therefore, there is a need for a portable camouflage screen that can be used efficiently and effectively with a firearm rest.

Another disadvantage for hunters with conventional firearm rests is that the firearm rests cannot be used in conjunction with known umbrellas. There are several varieties of umbrellas that are available to hunters, but none of which are adapted for use with a firearm rest. Conventional umbrellas are available for holding over oneself in a traditional manner with one's hand, attaching to a tree, or wearing on one's head as a hat. Such umbrellas, however, are cumbersome and awkward when using a firearm rest. The conventional umbrellas interfere with the hunter's handling of the firearm, inhibit the hunter's mobility, or effect the hunter's line of sight.

Therefore, there is a need for an umbrella that can be used with a firearm rest such that the hunter's, or shooter's, arms and body are free to handle the firearm.

SUMMARY OF THE INVENTION

The present invention solves the current problems associated with conventional firearm rests by providing a portable firearm rest that can be easily carried into the field and can be quickly secured to and removed from a vehicle. More specifically, the present invention is a single elongate, hollow shaft with a notched Y or U shaped cradle member at a top end for receiving and supporting a firearm, and a plug at a bottom end thereby allowing various equipment, such as a first aid kit, to be stored within the shaft. When used in the field, a hunter or shooter can use the present invention as a walking stick or as other means of support. Further, a hunter can slide the shaft into an oar lock, or similar opening, of a boat, thereby using the firearm rest on water as well as on land. A U shaped hook is also attached to the elongate shaft to provide firearm support at an alternate height.

The present invention also solves the current problems associated with conventional camouflage screens by providing a portable camouflage screen that easily and quickly adjusts from a face screen to a full body screen. The camouflage screen of the present invention is made of camouflage netting and has a rectangular pocket used as a face screen into which a full body screen, that is attached to the face screen, can be folded. The camouflage screen attaches to the notched cradle of the firearm rest, thereby providing a hunter with needed camouflage. The present invention provides a light weight, compact, adjustable camouflage screen that is easily attached to a firearm rest.

The present invention also solves the current problem of using a conventional umbrella with a firearm rest by providing a firearm rest on which a compact umbrella can be easily attached. The shaft of an umbrella fits into a vertical hole in the Y shaped cradle of the firearm rest, thereby securing the umbrella to the firearm rest and allowing the hunter or shooter to keep his/her hands free to shoot.

In an alternative embodiment, the present invention is a telescoping firearm rest having an elongate shaft with a notched Y or U shaped cradle member at a top end for receiving and supporting a firearm, a tube, and a locking mechanism such that the elongate shaft and the tube are connected via the locking mechanism. The locking mechanism is a twisting device. When the locking mechanism is twisted to an open position, the elongate shaft slides freely in and out of the tube, and when the locking mechanism is twisted to a closed position, the elongate shaft is frictionally held stationary within the tube. Therefore, the firearm rest can be adjusted easily, quickly, and silently to any height with the use of a single hand.

Further, the bottom of the tube of the alternative embodiment ends in a plus-shaped base that provides the firearm rest greater stability on the ground and allows the firearm rest to be quickly secured to and removed from a vehicle with, for example, bungee cords. The plus-shaped based allows the firearm rest to be securely attached to the floor of an open 4-wheel drive vehicle, as well as to the floor of a flat bottomed boat for hunting waterfowl.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
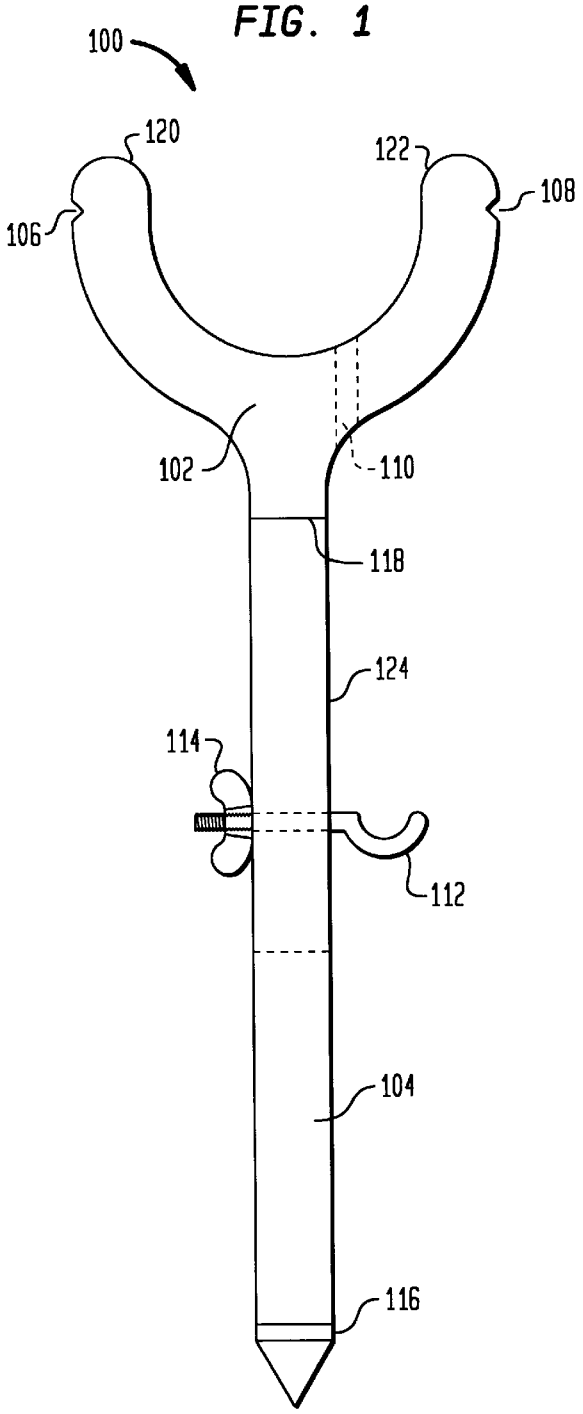
FIG. 1 is a block diagram illustrating the preferred embodiment of a firearm rest.

FIG. 1 illustrates the preferred embodiment of a firearm rest 100. The firearm rest 100 is comprised of a elongate shaft 124 at a top end of which is located a Y shaped cradle 102, and at a bottom end of which is located a plug 116. The elongate shaft 124 is preferable constructed from fiberglass, or similar material, for providing minimum weight and maximum strength and durability. The Y shaped cradle 102 has a stem 118 and two prongs or branches 120, 122 into which a hunter or shooter supports or rests his firearm. When shooting, the hunter or shooter holds onto the stem 118 of the Y shaped cradle 102 with his non-trigger hand for support; that is, he holds onto the stem 118 with the hand that does not pull the trigger of the firearm. When not shooting, the hunter or shooter can use the firearm rest as a walking stick or as another means of support for traveling in the field.

The Y shaped cradle 102 also has a vertical hole 110 located at the base of one of its branches 122 just off center from the stem 118. The vertical hole 110 will be discussed in greater detail below. Each branch 120, 122 of the Y shaped cradle 102 has a notch 106, 108 cut into the periphery of the branch 120, 122. The preferred embodiment of the Y shaped cradle 102 is injection molded from suitable plastic material and fits onto the top end of the elongate shaft 124. It would be readily apparent, however, to one skilled in the relevant arts to make a Y shaped cradle 102, or similar shaped cradle, from a comparable material.

The plug 116 is located at the bottom end of the elongate shaft 124 of the preferred embodiment of the firearm rest 100. The plug 116 provides an entrance way into a storage space 104 of the elongate shaft 124. The storage space 104 can run the entire length of the elongate shaft 124 or can be restricted to a fixed length within the elongate shaft 124. In the storage area 104, a hunter or shooter can store various items such as a first aid kit, matches or other necessary items. In its preferred embodiment, the plug 116 is pointed in shape thereby allowing a hunter or shooter to easily drive the firearm rest 100 into the ground such that the firearm rest 100 stands freely. The plug 116 is described as a pointed shape for convenience purposes only. It would be readily apparent to one skilled in the relevant arts to develop a plug with a comparable shape.

Another feature of the preferred embodiment of the firearm rest 100 is a U shaped hook located approximately midway on the elongate shaft 124. The U shaped hook 112 provides a hunter or shooter with an alternative shooting position, such as when sitting on the ground turkey hunting. The U shaped hook 112 is bolted to the firearm rest 100 by means of a butterfly nut 114. This alternative shooting position is described in terms of a U shaped hook for convenience purposes only. It would be readily apparent to one skilled in the relevant arts to provide firearm support at an alternate height in a comparable manner.

Figure 2:
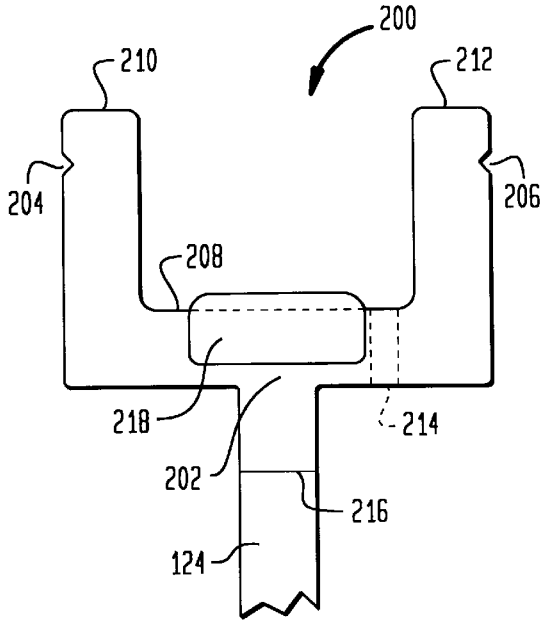
FIG. 2 is a block diagram of an alternative embodiment of the firearm rest with a block-U shaped cradle.

FIG. 2 is a block diagram illustrating an alternative embodiment of the Y shaped cradle 102. In this embodiment, a block-U shaped cradle 202 having a flat crosspiece 208 is attached at the top end of the elongate shaft 124. An advantage of a block-U shaped cradle 202 is that it provides greater support to a hunter or shooter when walking in the field. The hunter or shooter can place his hand over the entire flat crosspiece 208 with a more secure grip, thereby achieving greater stability and support when walking or being supported.

FIG. 2 also shows a pad 218 on the flat crosspiece 208 of the block-U shaped cradle 202. A pad 218 provides added comfort to a hunter or shooter when the firearm rest 100 is used as a walking stick, and provides extra stability and protection to a barrel of a firearm placed in the block-U shaped cradle 202.

Figure 3:
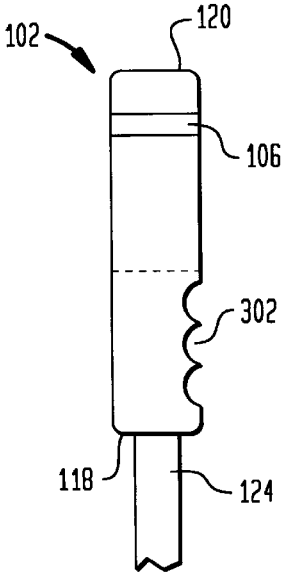
FIG. 3 is a detailed side view of an alternative embodiment of the firearm rest with a Y shaped cradle having a pistol handgrip.

FIG. 3 is a detail side view of an alternative embodiment of the Y shaped cradle 102. In this alternative embodiment, a pistol handgrip 302 is located on the stem 118 of the Y shaped cradle 102. The pistol handgrip 302 provides one or more notches, or indentations, into which a hunter or shooter places his fingers when holding the firearm rest 100. This alternative embodiment provides a hunter or shooter better stability and control of the firearm rest 100 when shooting.

Figure 4A:
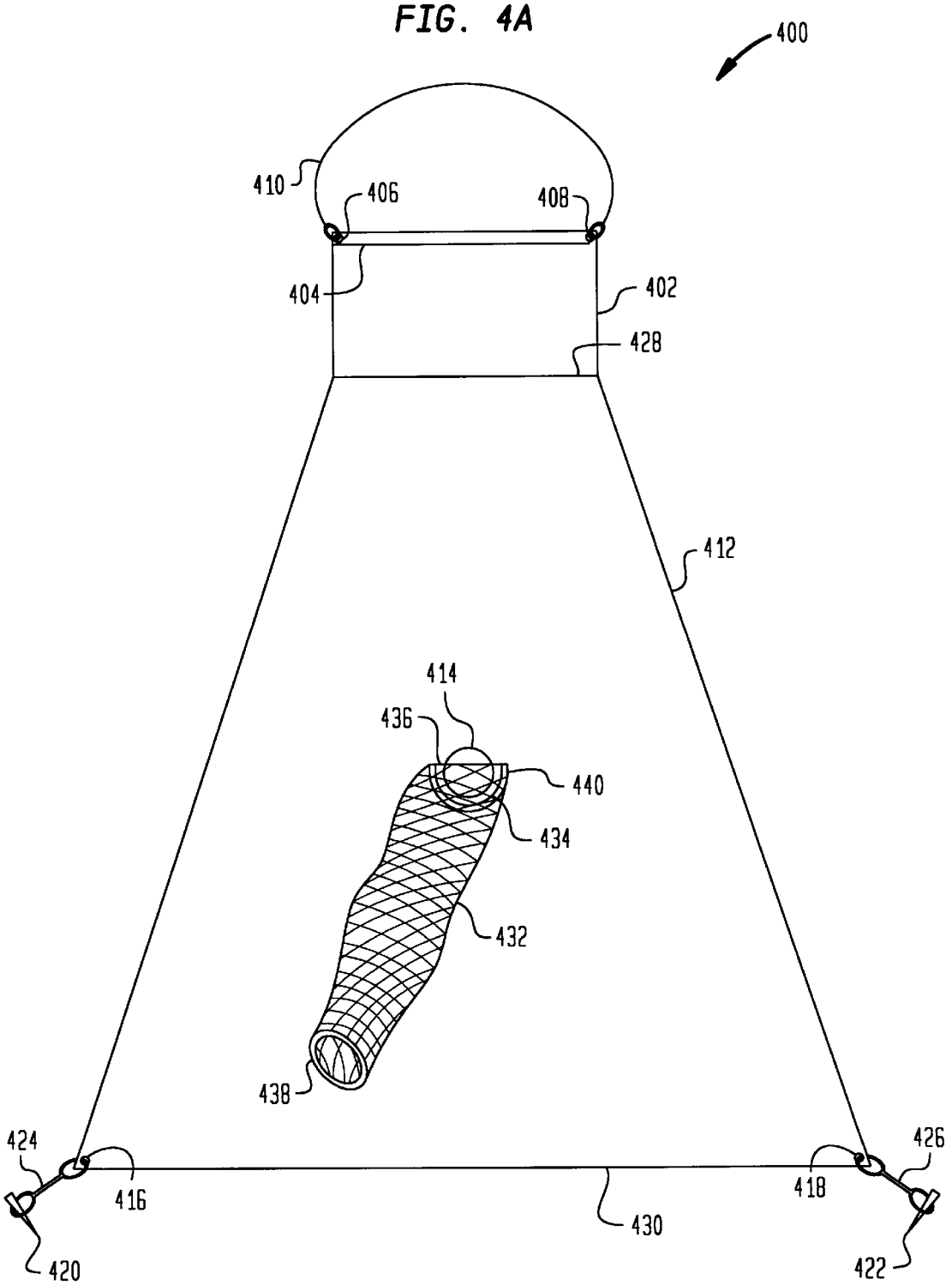
FIG. 4A is a block diagram illustrating the preferred embodiment of a camouflage screen with a barrel sleeve.

FIG. 4A is a block diagram illustrating the preferred embodiment of a camouflage screen 400. The preferred embodiment of the camouflage screen 400 is comprised of a face screen portion 402 and a body screen portion 412. The face screen portion 402 is rectangular in shape, made of two pieces of camouflage netting that are stitched together along three sides to form a pocket with an opening 404 along the top side of the face screen portion 402. At the corners of the opening 404 are two holes 406, 408. An elastic cord 410 is threaded through the holes 406, 408 as a means of attaching the camouflage screen 400 to the preferred embodiment of the firearm rest 100.

A body screen portion 412, also made of camouflage netting, is attached to the bottom side of the face screen portion 402 of the camouflage screen 400. The body screen portion 412 is trapezoidal in shape. Its top side 428 is the same length as the face screen portion 402, and the bottom side 430 is longer than the top side 428. The body screen portion 412 of the camouflage screen 400 has two holes 416, 418 located at the corners of the bottom side 430. These holes 416, 418 when used in conjunction with two stakes 420, 422 and two lines 424, 426 can be used to tie down, in a well known manner, the bottom side 430 of the camouflage screen 400, thereby providing a hunter with broader coverage. Another feature of the preferred embodiment of the camouflage screen 400 is a hole 414 located approximately in the center of the body screen portion 412 of the camouflage screen 400. A hunter uses this hole 414 by placing the barrel of his firearm through the hole 414 while in a sitting or squatting position behind the camouflage screen 400.

In the preferred embodiment of the camouflage screen 400, the body screen portion 412 is permanently stitched to the face screen portion 402. Thus, when a hunter wants to use only the face screen portion 402, or when traveling in the field, the hunter can roll up the body screen portion 412 and store it, with the lines 424, 426 and the stakes 420, 422, through the opening 404 of the face screen portion 402 into the pocket. In an alternative embodiment, the body screen portion 412 can be removably attached to the face screen portion 402 at its top side 428 with Velcro, snaps, a zipper, or any other comparable means.

The preferred embodiment of the body screen portion 412 also includes a removable barrel sleeve 432 placed over the hole 414. The barrel sleeve 432 is a tube of camouflage netting with a front end opening 438 and a back end opening 440. The back end opening 440 is attached to the body screen portion 412 with a Velcro strip 434, thereby providing for the quick removal of the barrel sleeve 432. The attachment of the barrel sleeve 432 is described in terms of a velcro strip 434 for convenience purposes only, it would be readily apparent to one skilled in the relevant arts to attach a barrel sleeve 432 by a comparable means.

In the preferred embodiment, the velcro strip 434 does not circle the entire hole 414, but rather circles a portion of the hole 414. At the two end points of the velcro strip 434 on the back end opening 440 of the barrel sleeve 432, there is a short elastic cord 436 that connects the two end points. When the barrel sleeve 432 is attached to the body screen portion 412, the short elastic cord 436 draws the top of the back end opening 440 down, thereby exposing a portion of the hole 414 such that the portion of the hole 414 is not covered by the barrel sleeve 432.

Figure 4B:
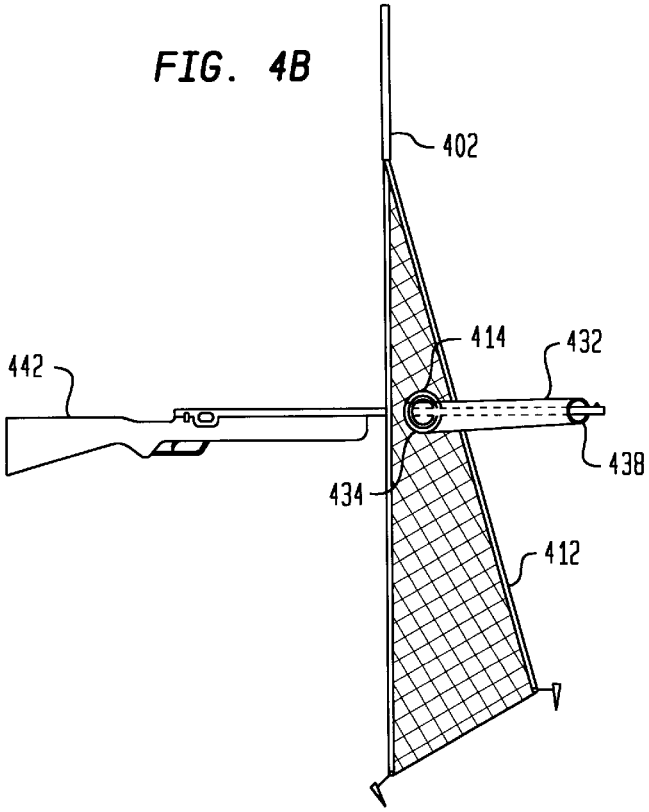
FIG. 4B is a detailed side view illustrating the operation of the preferred embodiment of the barrel sleeve of the camouflage screen.

FIG. 4B is a detailed side view illustrating the operation of the preferred embodiment of the barrel sleeve 432 of the camouflage screen 400. For convenience purposes only, the figure does not show the firearm rest 100 to which the camouflage screen 400 would be attached. As shown, a hunter or shooter attaches the barrel sleeve 432 to the body screen portion 412 of the camouflage screen 400 via the velcro strip 434. He then inserts the barrel of his firearm 442 through the hole 414 and through the barrel sleeve 432, thereby rendering himself and his firearm visually undetectable. The hunter can look through the camouflage screen 400 itself or can look through the exposed opening created by the short elastic cord 436. This exposed opening allows the hunter to use a scope or see the bead at the end of his firearm.

Figure 5:
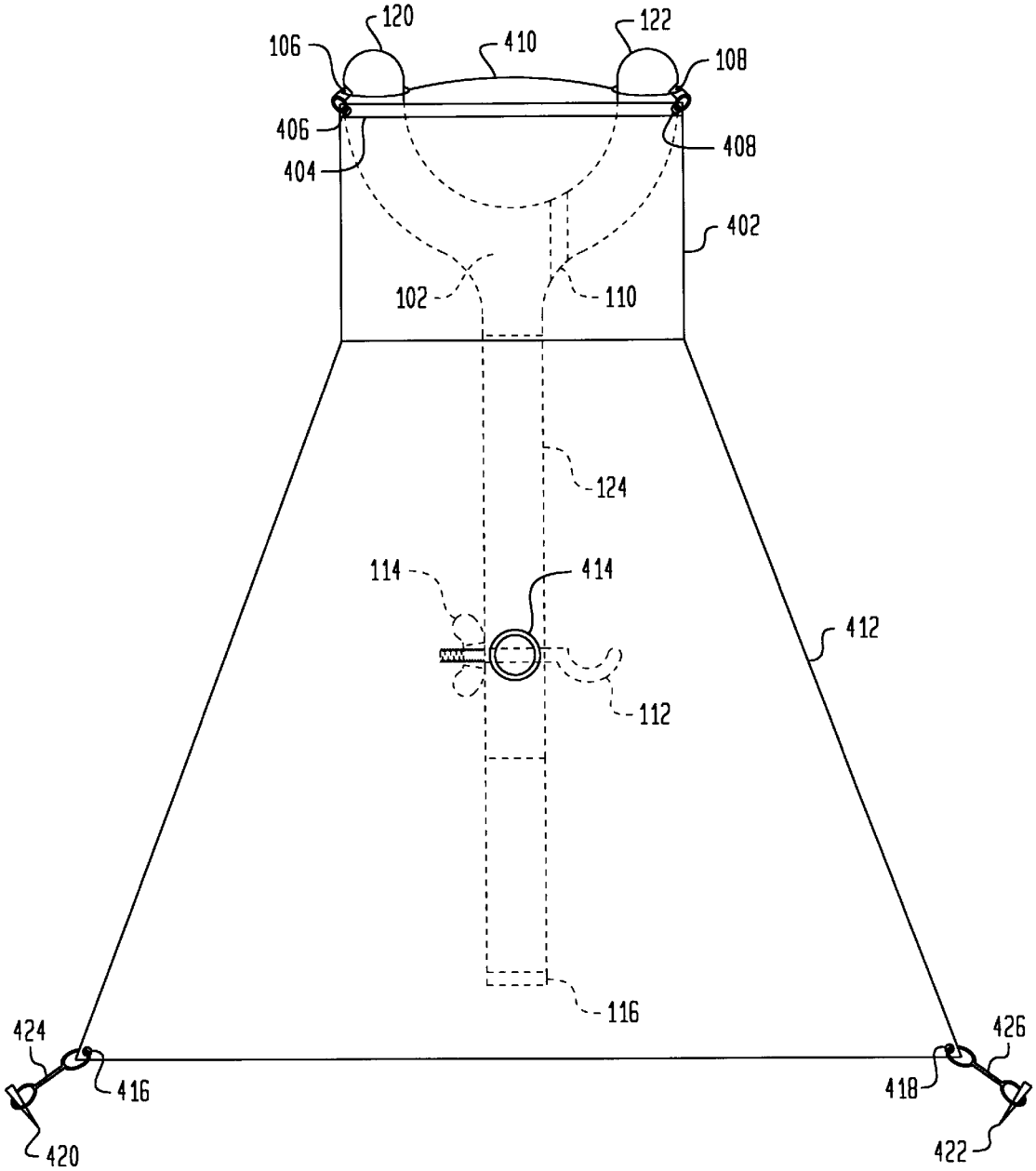
FIG. 5 is a detailed front view illustrating the preferred embodiment of the camouflage screen, without a barrel sleeve, attached to the preferred embodiment of the firearm rest.

FIG. 5 is a detail front view illustrating the preferred embodiment of the camouflage screen 400 attached to the preferred embodiment of the firearm rest 100. The camouflage screen 400 of FIG. 5 is shown without a barrel sleeve 432 for convenience purposes only. In operation, the elastic cord 410 of the camouflage screen 400 is looped around both ends of the branches 120, 122 of the firearm rest 100, such that the loops of the elastic cord 410 rest within the notches 106, 108 of the Y shaped cradle 102. The preferred embodiment is described in terms of an elastic cord 410 for convenience purposes only. It would be readily apparent to one skilled in the relevant art to develop comparable means for attaching the camouflage screen 400 to a firearm rest 100.

Further, the hole 414 of the body screen portion 412 of the camouflage screen 400 is approximately the same height as the U shaped hook 112 attached to the firearm rest 100. Therefore, when a hunter is in a sitting or squatting position and uses the U shaped cradle 112 for supporting his firearm, the barrel of his firearm is placed through the hole 414 of the camouflage screen 400. As described above, a hunter may attach a barrel sleeve 432 to further render himself and his firearm visually undetectable.

Figure 6:
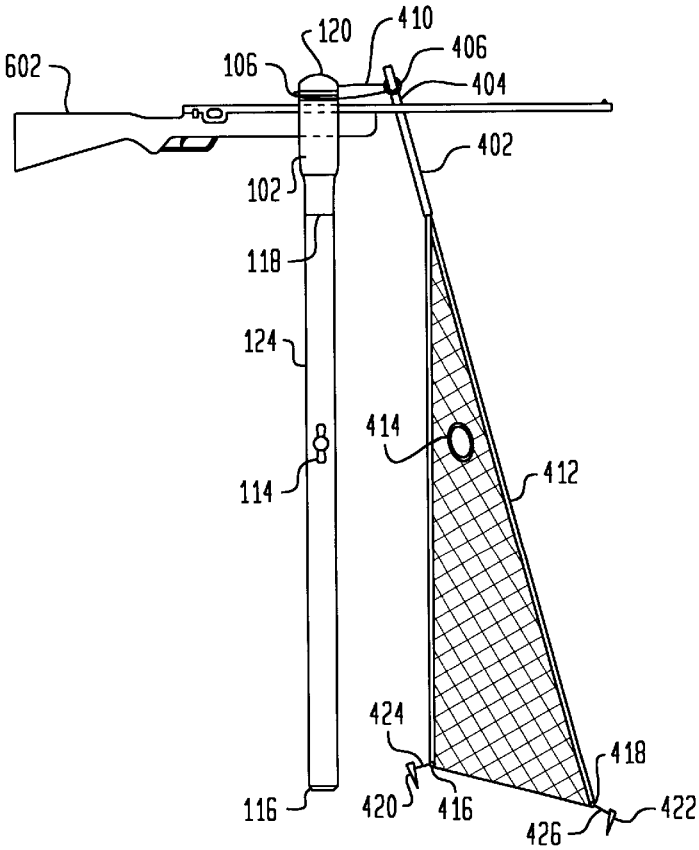
FIG. 6 is a detailed side view illustrating the operation of the preferred embodiment of the camouflage screen, without a barrel sleeve, attached to the preferred embodiment of the firearm rest.

FIG. 6 is a detailed side view illustrating the operation of the preferred embodiment of the camouflage screen 400 attached to the preferred embodiment of the firearm rest 100. The camouflage screen 400 of FIG. 6 is shown without a barrel sleeve 432 for convenience purposes only. In operation, a hunter or shooter places his firearm 602 within the Y shaped cradle 102 of the firearm rest 100. When the preferred embodiment of the camouflage screen 400 is attached to the preferred embodiment of the firearm rest 100 by means of the elastic cord 410, as described above, the hunter places the barrel of his firearm on top of the face screen portion 402 of the camouflage screen 400. The barrel pushes down the face screen portion 402 to accommodate the shooting of the firearm 602.

Figure 7:
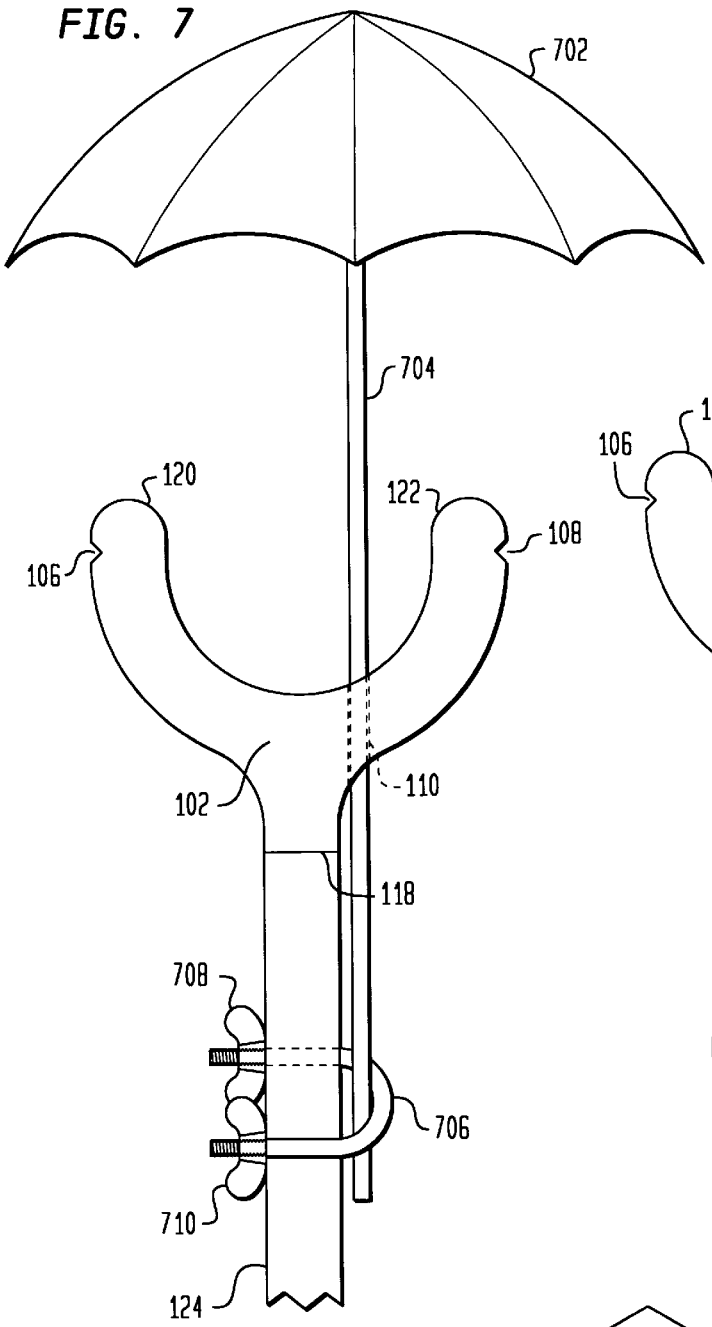
FIG. 7 is a block diagram illustrating the preferred embodiment of an umbrella attached to the preferred embodiment of the firearm rest.

FIG. 7 is a block diagram illustrating the preferred embodiment of an umbrella attached to the preferred embodiment of the firearm rest 100. The preferred embodiment of the umbrella comprises a canopy top 702 attached to an umbrella shaft 704. The umbrella shaft 704 is placed through the vertical hole 110 of the Y shaped cradle 102 of the firearm rest 100. A U shaped bolt 706 is used to anchor the bottom of the umbrella shaft 704 to the firearm rest 100 by means of two wing nuts 708, 710. This embodiment of the present invention allows a hunter or shooter to fully use the firearm rest 100 without requiring the use of his hands to hold the umbrella. Although the preferred embodiment of the present invention comprises the use of a vertical hole 110 in the Y shaped cradle 102 of the firearm rest 100 and a U shaped bolt 706 to secure an umbrella shaft 704, it would be readily apparent to one skilled in the relevant arts to develop and use alternative means for attaching an umbrella to the firearm rest 100.

Figure 8:
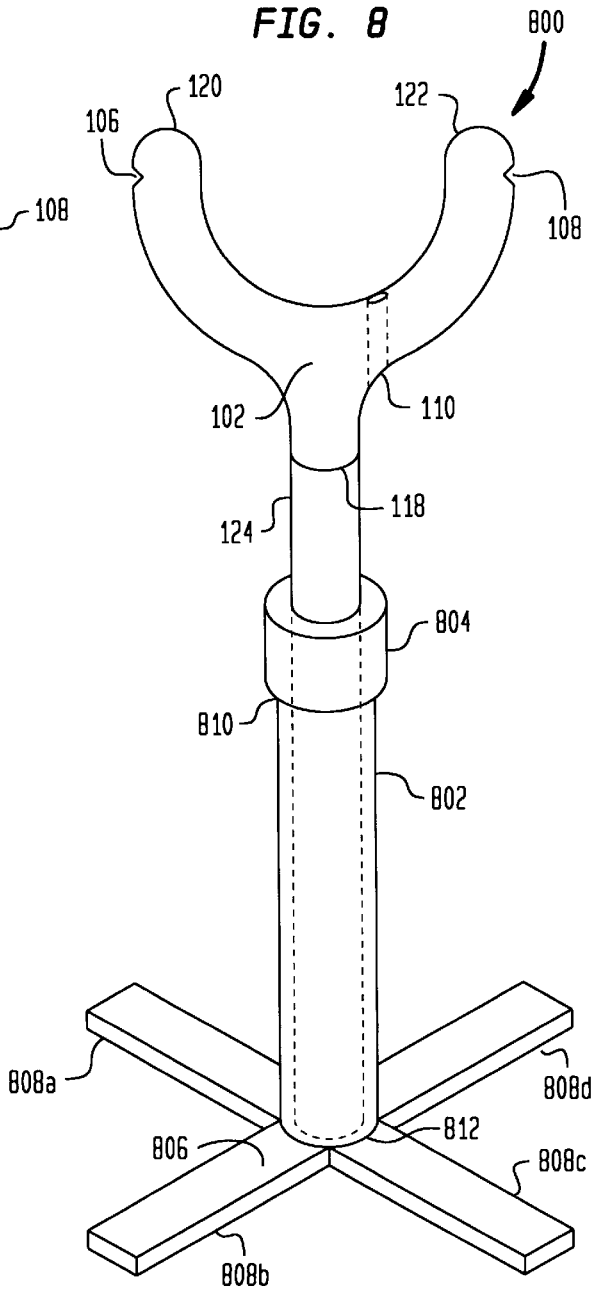
FIG. 8 is a block diagram illustrating an alternative embodiment of the firearm rest with a base platform.

FIG. 8 is a block diagram illustrating an alternative embodiment of the firearm rest 800 with a base platform

806. This alternative embodiment of the present invention comprises a hollow tube 802 having a top end 810 and a bottom end 812. The elongate shaft 124 of the firearm rest 800 is inserted into the tube 802. The tube 802 has a latching mechanism 804 located at its top end. The preferred embodiment of the latching mechanism 804 is a twisting device that has an open and a closed position. When the latching mechanism 804 is in the open position the elongate shaft 124 of the firearm rest 800 freely moves up and down within the tube 802. However, when the latching mechanism 804 is in the closed position, the latching mechanism 804 frictionally holds the elongate shaft 124 of the firearm rest 800 in a stationary position. At the bottom end 812 of the tube 802, there is a base platform 806. The preferred embodiment of the base platform 806 comprises a plus shape with extensions 808*a*, 808*b*, 808*c*, and 808*d*. The plus shaped base platform 806 provides stability to a hunter or shooter in the field as well as provides a means for attaching the firearm rest 800 to a vehicle such as a four wheel drive all purpose truck or a flat bottom boat. A hunter or shooter can simply use bungee cords, or similar attaching means, for securing the base platform 806 to the vehicle.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. A camouflage screen, comprising:

a face screen portion, rectangular in shape having a top side and a bottom side, made of a plurality of pieces of material stitched along three sides, thereby forming a pocket, with an opening at said top side of said face screen portion; and a means for attaching said camouflage screen to a firearm rest.

2. The camouflage screen according to claim 1, wherein said means for attaching the camouflage screen to the firearm rest, comprises:

an elastic cord, having two ends, wherein each said end of said elastic cord is attached to a corner of said top side of said face screen portion of the camouflage screen;

wherein said elastic cord wraps around each of two branches of a Y shaped cradle of the firearm rest, each said branch having a notch in its periphery such that said elastic cord sits within each said notch of each said branch.

3. The camouflage screen according to claim 1, further comprising:

a body screen portion, trapezoidal in shape having a second top side and a second bottom side; and a means for attaching said second top side to said bottom side of said face screen portion.

4. The camouflage screen according to claim 3, wherein said means for attaching is a first velcro strip on said second top side of said body screen portion and a second velcro strip on said bottom side of said face screen portion.

5. The camouflage screen according to claim 3, further comprising:

a means for securing said second bottom side of said body screen portion to the ground.

6. The camouflage screen according to claim 5, wherein said means for securing said second bottom side of said body screen portion to the ground comprises:

a plurality of stakes;

a plurality of holes, wherein one hole is located in each corner of said second bottom side of said body screen portion of the camouflage screen; and a plurality of cords connecting said stakes to said holes in said second bottom side of said body screen portion of said camouflage screen.

7. The camouflage screen according to claim 3, further comprising:

a hole in said body screen portion, wherein a barrel of a firearm fits through said hole.

8. The camouflage screen according to claim 7, further comprising:

a barrel sleeve, tubular in shape, having a back end opening and a front end opening; and a means for attaching said barrel sleeve to said body screen portion such that said back end opening of said barrel sleeve fits over said hole.

9. The camouflage screen according to claim 8, further comprising:

a short elastic cord attached to a plurality of points on said back end opening of said barrel sleeve such that when said barrel sleeve is attached over said hole of said body screen portion, a portion of said hole is uncovered.

10. The camouflage screen according to claim 8, wherein said means for attaching said barrel sleeve to said body screen portion is a first velcro strip on said back end opening of said barrel sleeve and a second velcro strip around said hole of said body screen portion.

11. A camouflage screen, comprising:

a face screen portion, rectangular in shape having a top side and a bottom side, made of a plurality of pieces of material stitched along three sides, thereby forming a pocket, with an opening at said top side of said face screen portion;

a body screen portion, trapezoidal in shape having a second top side and a second bottom side, wherein said second top side of said body screen portion is attached to said bottom side of said face screen portion;

a hole in said body screen portion, wherein a barrel of a firearm fits through said hole;

an elastic cord, having two ends, wherein each said end of said elastic cord is attached to a corner of said top side of said face screen portion of the camouflage screen;

a plurality of stakes;

a plurality of holes, wherein one hole is located in each corner of said second bottom side of said body screen portion of the camouflage screen; and a plurality of cords connecting said stakes to said holes in said second bottom side of said body screen portion of said camouflage screen.

12. The camouflage screen according to claim 11, further comprising:

a barrel sleeve, tubular in shape, having a back end opening and a front end opening; and a means for attaching said barrel sleeve to said body screen portion such that said back end opening of said barrel sleeve fits over said hole.

13. A firearm rest, comprising:

an elongate shaft having a top end and a bottom end;

a Y shaped cradle located at said top end of said elongate shaft, having two branches and a stem, each of said branches having a notch on its periphery;

a face screen portion, rectangular in shape having a top side and a bottom side, made of a plurality of pieces of material thereby forming a pocket with an opening at said top side of said face screen portion;

a body screen portion, trapezoidal in shape having a second top side and a second bottom side, wherein said second top side of said body screen portion is attached to said bottom side of said face screen portion;

a means for attaching said face screen portion to said Y shaped cradle; and a means for securing said second bottom side of said body screen portion to the ground.

* * * * *